US007073306B1

(12) United States Patent
Hagaman

(10) Patent No.: US 7,073,306 B1
(45) Date of Patent: Jul. 11, 2006

(54) METHOD OF BUILDING

(76) Inventor: Harry Edward Hagaman, P.O. Box 1229, Healdsburg, CA (US) 95448

( * ) Notice: Subject to any disclaimer, the term of this patent is extended or adjusted under 35 U.S.C. 154(b) by 0 days.

(21) Appl. No.: 10/799,219

(22) Filed: Mar. 12, 2004

Related U.S. Application Data

(60) Provisional application No. 60/474,031, filed on May 29, 2003.

(51) Int. Cl.
*E04G 21/00* (2006.01)

(52) U.S. Cl. ..... 52/745.09; 52/742.1; 52/DIG. 9; 249/34; 249/20

(58) Field of Classification Search ..... 52/745.1, 52/747.1, 79.9, 79.13, 223.7, DIG. 9, 745.19, 52/746.1, 745.09, 742.1; 249/20, 33, 34
See application file for complete search history.

(56) References Cited

U.S. PATENT DOCUMENTS

| | | | | | |
|---|---|---|---|---|---|
| 225,065 | A | | 3/1880 | Leeds | |
| 312,375 | A | | 2/1885 | Orr | |
| 801,361 | A | | 10/1905 | Clayton | |
| 845,635 | A | | 2/1907 | Ham | |
| 1,084,967 | A | * | 1/1914 | Rosenleaf | 52/381 |
| 1,136,792 | A | | 4/1915 | Goldsmith | |
| 1,450,724 | A | | 4/1923 | Hewlett | |
| 1,604,097 | A | | 10/1926 | Hewlett | |
| 1,633,702 | A | | 6/1927 | Hewlett | |
| 2,496,616 | A | * | 2/1950 | Barton | 264/33 |
| 2,613,424 | A | | 10/1952 | Kenney | |
| 3,946,660 | A | * | 3/1976 | Kuhtreiber | 100/39 |
| 4,421,766 | A | * | 12/1983 | Morisawa et al. | 514/549 |
| 4,768,324 | A | | 9/1988 | Hibbard | |
| 5,398,472 | A | | 3/1995 | Eichelkraut | |
| 5,749,199 | A | * | 5/1998 | Allen | 52/729.1 |
| 5,937,588 | A | * | 8/1999 | Gard | 52/79.1 |
| 6,061,986 | A | | 5/2000 | Canada | |
| 6,412,251 | B1 | | 7/2002 | Early | |
| 6,713,168 | B1 | * | 3/2004 | Liu et al. | 428/292.4 |
| 6,718,712 | B1 | * | 4/2004 | Heath | 52/309.12 |
| 6,718,722 | B1 | * | 4/2004 | Worrell et al. | 52/741.13 |
| 6,872,674 | B1 | * | 3/2005 | Williams et al. | 442/416 |

FOREIGN PATENT DOCUMENTS

| | | | | |
|---|---|---|---|---|
| CA | 2194193 | * | 6/1998 | 52/DIG. 6 |
| DE | 29701746 U1 | * | 4/1997 | |
| DE | 29701746 | * | 5/1997 | |

OTHER PUBLICATIONS

Chiras, The Natural House, 2000, 33-95, 123-167, 234-238, Chelsea Green Publishing Co., White River Junction, Vermont.
Gray, Australia's Secret! 60-Year-Old Straw Houses, The Last Straw, Fall 2005 Issue # 51, GPFS, Lincoln, Neb.
Web Advertisement Page for Solomith Strawboard, enquires@solomit.com.au, (03) 9793 3088.
Reference to 'Solomit' From www.timbershop.org.au/product/interior/linings.html.

* cited by examiner

*Primary Examiner*—Naoko Slack
(74) *Attorney, Agent, or Firm*—Larry Williams

(57) ABSTRACT

This is an improved method of building with fibrous material though other materials can be substituted. A binding secures fibrous material to form a wall assembly (10). Wall surfacing (20) can be included in the binding and forming process, reducing the labor required to apply it. Other building features and components can also be included in the binding and forming process such as electrical wiring, furring strips, windows, doors and structural reinforcing. This method vastly reduces the difficulties encountered when installing these components. The versatility of the method also allows for attributes such as flat wall surfaces and variable wall thicknesses, which are difficult to achieve using baled fiber.

38 Claims, 7 Drawing Sheets

METHOD OF BUILDING

CROSS REFERENCE TO RELATED APPLICATION

This application is entitled to the benefit of Provisional Patent Application Ser. No. 60/474,031, filed 2003 May 29

FEDERALLY SPONSORED RESEARCH

Not applicable

SEQUENCE LISTING OR PROGRAM

Not applicable

BACKGROUND OF THE INVENTION—FIELD OF INVENTION

This invention relates to the building of structures, specifically to an improved method of building structures.

BACKGROUND OF THE INVENTION

Shelter from the elements is a necessity of mankind. In recent years, increased focus has been placed on the need to develop construction methods and materials that minimize impacts on energy demands and environmental quality. Other concerns are for buildings and dwellings that are energy efficient, thereby reducing demand on energy sources. Similarly, there is a heightened awareness of the importance of conserving natural resources and using refuse materials in their place when possible. Conventional wood framed construction is ill adapted to these needs. Wood is a limited natural resource. Most construction lumber is now imported. A greater proportion of sapwood is being used, which effects the quality and longevity of the structure. Wood framing does not adapt well to thicker, highly insulated walls and requires additional wood and labor to accommodate thicker insulation. Steel framing and masonry building methods are energy and resource intensive and difficult to insulate. For these and other reasons, builders have began to build with new methods and materials such as straw bale construction. Though the method of this invention may be adapted to many ways of building, there is no previous building method which is closely related. Though different, straw bale building is the most related prior art.

Straw is an inexpensive, widely available resource. Straw has for centuries been used in the art of building construction, and straw's use in the art has expanded recently. The use of straw as a construction material has many advantages over conventional building materials. Straw and other suitable fibrous materials offer high insulation, low weight, are economical, widely available, and are often considered refuse materials. The use of straw in the art of building is desirable from an environmental, energy-efficiency, economic standpoint.

Straw bales have been used in construction since the nineteenth century. Originally, bales were used as infill in post-and-beam structures. U.S. Pat. No. 225,065 to Leeds, entitled Building Houses, Barns, Fences &c. discloses a mode of erecting structures consisting of stacking baled matter within wooden corner posts and capping them with wooden planks. No surface coating or finishing is suggested.

Methods then developed to improve wall surfacing of bales. U.S. Pat. No. 312,375 to Orr, entitled Wall of a Building and Other Structures, discloses a system of building walls which involved the stacking of bales of material, and holding the bales together by tightening bolts and plates to give them a sufficient firmness to admit their being plastered.

The inclusion of concrete and steel for structural purposes developed. U.S. Pat. No. 801,361 to Clayton, et al., entitled Wall Surfacing Building Structure, shows the formation of walls and roofs fashioned from concrete shells surrounding baled straw. U.S. Pat. No. 1,450,724 and U.S. Pat. No. 1,604,097, both to Hewlett and both entitled Wall Structure, show a construction system using fibrous material such as wood shavings and a binding agent to form rigid yet lightweight building blocks. The rigid blocks are then stacked to form a wall. There are holes through the rigid blocks so that when they are aligned vertically, the holes become vertical molds for steel re-enforced poured concrete. As disclosed, the system required the manufacture of individual blocks by mixing the cementious binding agent with the fibrous material to exacting specifications to form what is, essentially, a type of brick. Aforementioned U.S. Pat. No. 1,450,724 also shows wall surfacing supported by metal lath.

U.S. Pat. No. 5,398,472 to Eichelkraut, entitled Fiber-Bale Wall Surfacing Structural System and Method shows a construction system utilizing baled fibrous material stacked against a temporary support system. Reinforcing ribs or beams are used to enhance load-bearing capabilities. Walls are covered with a rigid layer, preferably concrete. Methods and apparatuses are disclosed for transferring shear forces between rigid exterior layers.

More recently, the expense of providing a very wide footing to accommodate the width of the bales and methods to allow water vapor to exit the bales have been addressed. U.S. Pat. No. 6,061,986 to Canada, entitled, Reinforced Stucco Panel and Straw Insulator Wall Assembly shows an insulated slab foundation being used to reduce foundation expense incurred from wide bales. It also shows a semi-permeable fabric encasing and stacked bales. The semi-permeable fabric may help keep the fiber dry for several years, but these fabrics have a short life span compared to the expected life of the structure. There are a number of methods currently employed by those in the straw bale construction trade that avoid the use of these fabrics. Minimizing moisture contact with the fiber and the use of materials that allow vapor to pass out of the structure are the most widely practiced ways to deal with moisture, and these ways work well, though in some situations other measures will need to be taken. Paints that stop water droplets from getting in but allow vapors to readily pass through are now available, which adds to the list of ways to effectively deal with moisture.

Compressed fiber performs well as a building material, but the above-mentioned methods of building with stacked fiber bales suffer from a number of disadvantages:

(a) The nature of straw bales prohibits their being securely attached or mortared at their joints to form a monolithic wall.

(b Some means must be provided to add tensile and compressive strength to a straw bale wall.

(c) Fiber bales to be utilized as a building material must be uniform and of a fairly high density, which requires additional attention in their making.

(d) Standard two and three string bales are large and cumbersome resulting in wide walls, which may not be needed or wanted.

(e) The lumber used to frame interior partition walls is often equal to the amount of lumber used in framing exterior walls. Straw bale width is usually not suited for interior partition walls. Hence straw bales are limited in their ability to save wood resources.

(f) The thick walls resulting from wide bales can require costly foundations.

(g) Bales must be held firmly together during construction and after completion of the structure to withstand wind and other forces.

(h) Fiber walls are vulnerable to moisture during the interval between erecting the walls and applying a wall surface.

(i) Bale surfaces are irregular. Hence, flat wall surfaces are difficult to achieve.

(j) In order to fit around windows, doors and posts, bales must be shaped on site, which is a labor-intensive process.

(k) Bales are often an obstruction to including other construction features such as electrical wiring, furring strips, plumbing and structural reinforcement, requiring cutting, drilling and re-shaping of the bales.

(l) Plastering interior and exterior bale surfaces requires an extensive amount of labor. In spite of many attempts to improve the art of straw bale building, no one since or before has come up with a solution to this daunting task.

(m) Pre-compression of load bearing straw bale walls is usually required. Current pre-compression methods do not provide optimal pressure, and require additional labor.

Moreover, these past methods of building with straw are poor as evidenced by the fact that few are using these methods in the building trades. This invention will bring practical, low cost, highly energy efficient fiber construction to the conventional building trades so that large housing developments can be built using the method of this invention. Yet at the same time, the systems described herein are scalable in such a way that the owner builder can also erect safe, well insulated housing. Emergency housing needs in areas with scant resources will also benefit from this method.

BACKGROUND OF THE INVENTION—OBJECTS AND ADVANTAGES

Accordingly, besides the objects and advantages described above, several objects and advantages of the present invention are:

(a) to provide a building method for rapidly erecting inexpensive, energy-efficient structures.

(b) to provide a building method for improving the structural strength of fiber structures.

(c) to provide a building method that makes use of renewable resources, most of which are presently wasted.

(d) to provide a fiber building method in which standard size bales are not required.

(e) to provide a fiber building method that eliminates the need to attach bales to each other.

(f) to provide a building method that can vary thickness of fiber walls to achieve the insulation, aesthetic and structural properties favored. Thinner fiber interior partition walls as well as thinner perimeter walls can be constructed, saving interior space and possibly foundation expense. Thicker walls are also possible.

(g) to provide a fiber building method to achieve flat wall surfaces.

(h) to provide a building method in which any shape can be achieved according to design and materials.

(i) to provide a building method in which structural bracing and other reinforcement materials can be easily included.

(j) to provide a building method that works in conjunction with other types of building methods, including conventional stick framing, SIPS, post and beam, and others.

(k) to provide a building method in which the fiber density can be varied so as to increase compressive strength or insulation value.

(l) to provide a building method in which other construction steps or building features can be included during the construction process, eliminating the need to modify bales to install electrical wiring, plumbing and other items.

(m) to provide a building method that reduces the time and labor required to apply wall surfacing.

(n) to provide a building method to apply wall surfacing simultaneous with wall raising. Thus eliminating the time that unsurfaced straw is exposed to moisture.

(o) to provide a building method to regulate plaster thickness.

(p) to provide a building method to cover the plaster to facilitate proper curing.

(q) to provide a building method that presses the plaster farther into the fiber and lath, which improves adhesion as well as improving structural strength.

(r) to provide q building method which can be done by hand or mechanized and automated to any degree desired.

(s) to provide a fiber building method that improves pre-compression for load bearing structures.

(t) to provide a building method for greater load bearing capability.

(u) to provide a building method in which the physical characteristics of building materials and their arrangement in a structure can be reduced to quantifiable characteristics. From these quantifiable structural characteristics, simulations and calculations regarding how a structure will respond to stresses can be determined. This feature of the invention aids architects, engineers, and building inspectors design safe structures.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

SUMMARY OF THE INVENTION

In accordance with the present invention a structure comprises a bound fiber wall assembly.

DRAWINGS—FIGURES

The accompanying drawings, which are incorporated into and from a part of the specification, illustrate several embodiments of the present invention and together with the description, serve to explain the principles of the invention. The drawings are only for the purpose of illustrating a few embodiments of the invention and are not to be construed as limiting the invention.

In the following detailed description, reference will be made to the attached drawings, in which.

DRAWINGS—REFERENCE NUMERALS

Figure 1:
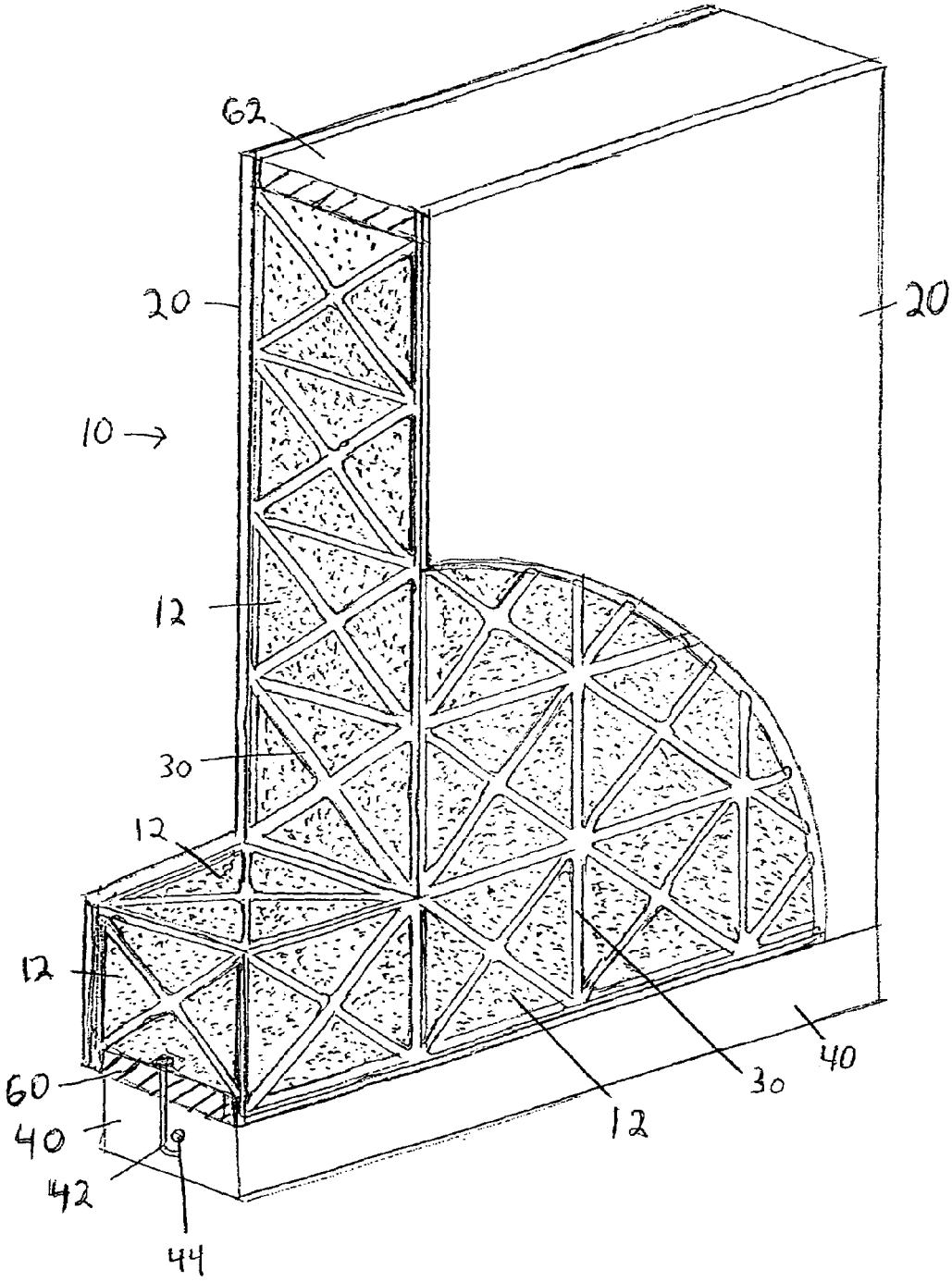
FIG. 1 is a perspective drawing with a cutaway of a wall assembly.

10 wall assembly
11 wall assembly
12 fiber
13 fiber glue mixture
14 loose straw
15 interwoven fiber
16 compressed straw
17 weaving device
18 adobe
19 wall surfacing
20 plaster
26 plaster spacer
30 binder
31 binder frame assembly
32*a* locking mesh
32*b* locking mesh
33*a* locking mesh
33*b* prong
34 mesh
35 wire
36 rigid tie
37 wire wrapping tool
38 locking retainer
38*a* locking retainer component
38*b* locking retainer component
39 plate to fiber connector
40 concrete slab
42 anchor
44 rebar
50 release membrane
52 pressure plate
58 access gap
60 bottom plate
62 top plate
64 form board
66*a* surface form
66*b* surface form
68 box form
68*a* adjustment control
70 outlet box
72 spacer attachment plate
74 anti-pullout flange
76 conduit
80 fastener
81 fastener
82 nut
83 connector
85 rod
88 corner angle bracket
90 hydraulic ram
91 support apparatus
92 compression assembly
93 hydraulic jack
94 mount
95 pipe supports
96 floor flanges
97 pipe clamps
98 hydraulic pump, pressure gauge, and control unit

DETAILED DESCRIPTION

FIG. 1—First Embodiment

The building method of this invention relates to systems for erecting structures of various types, and may satisfactorily be practiced to erect residential, commercial, or even industrial buildings, although it is contemplated that the invention shall have most widespread application in residential construction. The systems of the present invention may include the erection of walls, roofs, and floors. The methods of constructing a wall are repeated, with indicated adaptations and variations, throughout the erection of the plurality of walls required to complete the desired structure. Description of the erection of one wall (or floor/roof) will, therefore, enable one skilled in the art to adapt and adjust the disclosed methods and systems to accomplish the erection of any number of walls (and/or roofs or floors) needed to erect a more complex structure. The invention is widely applicable and some of the descriptions tend to be general because there are so many ways to use the invention. Also as there is no previous building method which is closely related, the terms and language used may not be as descriptive as the inventor has tried to be.

FIG. 1 is a perspective drawing with a cutaway of a wall assembly, generally designated 10 of the present invention. A typical wall assembly 10 resulting from the method of the present invention includes: a concrete slab 40 with a rebar 44 reinforcement, an anchor 42, a bottom plate 60, a fiber 12, a binder 30, a wall surfacing 20, a top plate 62, and a forming system (not shown) is typically used to facilitate assembling the wall assembly. A compression system (also not shown), is used when a compressed fiber assembly is desired. A monolithic fiber assembly is preferred though the assembly is not limited to being monolithic.

Wall assembly 10 can be a wall, floor, ceiling, roof, or furniture. The wall assembly 10 can be used in a one-story building or a multiple-story building, and may have any suitable shape and size, depending upon the structural requirements and design of the building.

The present invention preferably is practiced upon a conventional, poured, reinforced concrete slab 40 common to the construction art. Other ground pads may be utilized, provided the pad is sufficiently stable to allow the securing of a bottom plate 60 to the pad. Concrete slab 40 is preferred for its ability to retain rebar 44 and anchor 42, used to secure the wall assembly 10 to concrete slab 40. A bottom plate 60 is shown secured to concrete slab 40 by anchor 42. A wood bottom plate is common to the building trades and a wood bottom plate 60 is preferred for wood's ability of to accept attachments to various elements of the invention, as well as raising the fiber above floor level, and to attach other items like base board, though any suitable way to secure the wall is acceptable.

At the core of wall assembly 10 is fiber 12. A preferred fiber 12 is straw. A variety of other materials may be substituted in lieu of straw, such as shredded paper, shredded cornstalks, shredded plastic, mixtures of straw and earth, mixtures of fiber and/or earth with glue, fiber and clay, foam type insulators, or any other organic or non-organic fibrous material capable of being bound. Throughout this application, the terms straw and fiber shall be used and understood to mean any suitable material. The fiber has insulation and thermal mass qualities. It can absorb sounds. The fiber used may have tensile and compressive attributes which can play a role in the structural characteristics of the building. If compressed straw is used during the manufacture and building of a panel, the fiber can be compressed to varying design compressive strengths to improve structural and/or insulation properties. This is accomplished by compression testing, or by including instrumentation in the compression process. A pressure gauge on a hydraulic ram is an example of an instrument that would enable the fiber's compressive strength to be determined. During construction, the fiber can be applied by manual or automated means.

Binder 30 is illustrated in the cutaway section of FIG. 1. The binding is a cage which plays a number of roles in the structure. The binding lends structural strength to the building, and holds fiber 12 in its structural shape. The binding secures fiber 12. The binding can be a singular element or a configuration of elements. These elements may be all of the same material and/or varied materials. The flexibility of the binding allows other structural supports to be used in conjunction with the binding and they can often be incorporated into the binder as an element of the binding apparatus.

Binder 30 in FIG. 1 is illustrated with a crisscrossed material that covers each wall surface, and with crisscrossed linking members that attach the wall surfaces together. Any suitable design or pattern can be used for the binder on the wall surfaces and for linking members. These binder designs play a significant part in the structural characteristics and construction of the structure. Binder 30 has a number of structural qualities. Binder 30 and wall surfacing 20 work together to form a composite material with improved structural properties. These structural properties can be ascertained and used in structural design. The binder 30 transfers forces between the wall surfaces and so the binder is also a shear force transfer device. Bindings can be designed and fabricated of materials that reduce heat transfer and/or with thermal breaks. Binding connections as devices that transfer force between wall surfaces can be routed a variety of ways including but not limited to diagonal and perpendicular to the wall face planes. The variety of ways in which interconnects can be used between the wall surfaces gives this binding system increased flexibility in structural design. A variety of materials and design geometries can be utilized and engineered to meet structural requirements. Binders can supply stiffness to the panel. The binder's taut enclosure of the fiber secures the compressive strength of the fiber. The binder adds tensile strength to the structure. The compressive strength of the fiber and tensile strength of the binder together form a monolithic bound fiber structure. The binder also connects the transitional members of the wall assembly 10 and is shown attached to bottom plate 60, which connects and secures the wall assembly to the foundation. Binder 30 also attaches to top plate 62 connecting and supporting a roof or upper floor.

Any suitable binding method and building material that binds the straw can be used as a binder including wire mesh, lath, expanded metal lath, jute, bailing twine, bailing wire, cable ties, strapping, wood, composite material, glue and/or the mixture of any binding substances, wrapping material, interweaving of the fiber 12 material so as to be its own binder, and materials specifically fabricated to provide binding. Non-corrosive binders are preferred. Binding can be done by hand or industrialized and automated to any degree desired. An advantage of this binder system is the ability to engineer panels to structural standards. In engineering a structure, the various binder members can be assembled in a wide variety of structural geometries and the building materials can be selected for their structural properties concerning tension, compression, strength, stiffness, elasticity, and brittleness. This gives an engineer the flexibility to design the binder in a way that takes advantage of the best structural material and geometry to enhance a building's structural properties. By using materials in panels whose structural properties are known, and using these materials in specific structural geometries, a panel's structural characteristics can be accurately simulated and calculated. Current computer technology make this a relatively simple task. The ability to accurately ascertain a panel's structural characteristics adds to the safety and durability of the structure.

The right and left sides of FIG. 1 show a wall surfacing 20. Wall surfacing 20 has structural attributes which interact with the other elements as described above. Wall surfacing 20 is also a barrier between fiber 12 and its surrounding environment. A wide array of possible wall surfacing materials can be used, giving the designer a number of choices to meet the structure's requirements. A preferred material for wall surfacing 20 is plaster. A variety of other construction materials may be substituted however, including portland cement stucco, lime plaster, gypsum, ply siding, wood siding, earthen plaster, any plaster substitute that tends to stiffen, or other suitable wall surfacing. Throughout this application, the terms wall surfacing, plaster, and stucco shall be used and understood to mean any suitable wall surfacing material. Because the walls are usually shaped with a form in this building method, wall surfacing 20 application can be done during the forming process when the structure goes up, rather then applied later. This feature reduces the labor it takes to surface the walls and decreases the time that the fiber is exposed to the elements.

In this application form refers to any structural form and/or forming system. The terms form and forming system are used interchangeably. Shaping by hand, tool, and machine are also forms and forming systems in this applic-tion. Forms are usually used when constructing a typical wall assembly 10, though they may be unnecessary in some cases. The forms provide a support to shape the structure. They provide a way to construct flat surfaces, round surfaces, and curved vaults and other shapes, as desired. Forms aid in building the structure. They can provide temporary support for the structure, though other bracing may be required. Forms can aid in the application of plaster. Forms can be designed and built to be used over again, and for on many different types of structures. Because of the wide range of materials that can be used and the flexibility of this building method, the forms can interact with and/or serve as other elements and other elements can serve as forms. Thus forms can be an element of the binding and/or the binding can be the form. Wall surfaces can serve as forms, and forms can also serve as wall surfacing. When compressed fiber is used with this method, the forms serve as part of the compression system also.

Compression equipment is used in the construction of a wall assembly 10 to build a bound compressed fiber structure and/or a monolithic bound compressed fiber structure. When compressing equipment is used, measures are taken to protect elements that should not be subjected to pressure. Compression provides fire resistance and structural strength to straw. The compression process can aid in the plastering of the bound compressed fiber structure by squishing the plaster into the binding and fiber. There are many possible ways to compress the fiber. The compression system chosen works in conjunction with the forming of the structure. Pressure to compress a fiber wall can be applied to a wall face or a wall edge, and/or to multiple wall surfaces. Fiber is urged on at least one side to compress it. Fiber structures can be formed and/or compressed in one operation, numerous operations, panels, modular units, layers, vertical layers, and in smaller sections of each layer to build up a wall or any other suitable way. These methods are compression systems and forming systems. A compression system must provide adequate pressure and preferably has instrumentation to indicate how much pressure is exerted on the fiber. Various machines and tools can be used to generate and apply the pressure, including but not limited to, a hydraulic ram, a balloon bag, a back hoe, a jack, a bolt, a vacuum, and a pump.

There are many ways to build a wall such as wall assembly 10. An overview of some of the possible building approaches follows.

FIGS. 2A Thru 4B—Additional Embodiment

Figure 2A:
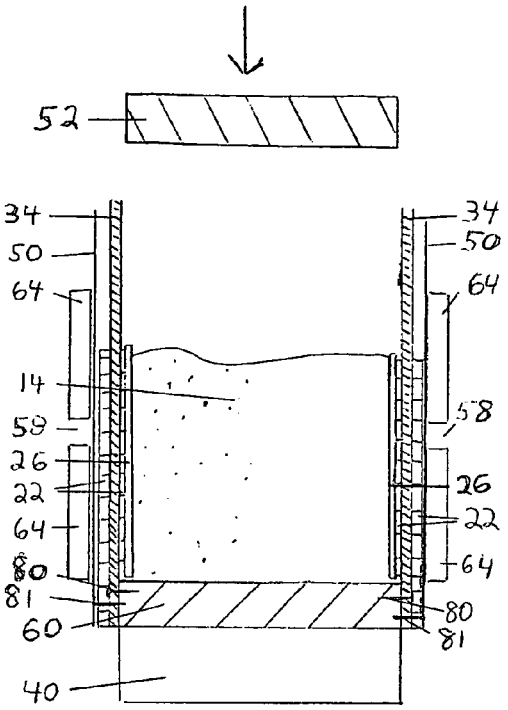
FIGS. 2A and 2B are cross sectional views of a construction step.

FIG. 2A is a cross section of a wall showing a method of constructing a fiber wall in consecutive layers and/or segments of layers. FIG. 2A includes a bottom plate 60, on top of which is shown loose straw 14. Each side of loose straw 14 shows a plaster spacer 26, plaster 22, mesh 34, a release membrane 50, and form boards 64. Mesh 34 is fastened to bottom plate 60 with fasteners 80 and release membrane 50 is fastened to bottom plate 60 with fasteners 81. Above loose straw 14, a pressure plate 52 is shown. The arrow above it denotes its direction of movement during compression.

In constructing the wall, as seen in FIG. 2A, mesh 34 is first attached vertically to each side of bottom plate 60 by means of fasteners 80. A layer of release membrane 50 is then placed over mesh 34 and stapled with fasteners 81. Release membrane 50 is used throughout this application to denote any suitable substance or separator used to facilitate the use of the forms in building a wall. The release membrane 50 chosen will depend on the type of wall surfacing material and forms used. For instance if a plaster is to be used, then a burlap cloth could be chosen as release membrane 50. Some wall surfacing materials will not require a release. Also the particular forms used may be such that a plaster will not adhere to them. The forms may be coated with various agents to release the surfaces from the forms including cloths, Teflon, petroleum jelly, plastic sheathing, and mold release agents or any other suitable material. The release membrane may also serve other functions like a covering to keep a wall surface moist and protected from the sun while curing. Burlap coverings are commonly used for this purpose on plaster.

Next, form boards 64 are erected vertically on the right and left sides of the wall to be constructed. Space is left between each layer of form boards 64. This gap provides access for tying the meshes together and is referred to as access gap 58. Plaster spacer 26 are placed vertically adjacent to each form board 64, and loose straw 14 is inserted. The plaster spacer facilities the insertion of plaster. It can also be used to regulate the plaster thickness by adjusting its position.

When adding the loose straw 14 the fibers will tend to intermesh especially if care is taken to intermix them as they are applied. It is preferred that enough loose straw 14 be inserted so that after compression it is higher than the level of the first gap between lower form board 64 and the form board 64 above it. Thus the fibers will extend into two or more bound adjoining areas so as to construct a monolithic fiber wall by allowing the fibers to intermesh between layers. In this way the use of this binding method allows one to build a monolithic fiber structure, which is an important improvement over the current art.

In a monolithic fiber structure, the binder secures the fiber, and the secured fiber becomes an integral part of the structure's characteristics. It is the opinion of the inventor that, in addition to the above mentioned interactions between the binder and fiber, when more stress is placed on the structure, and hence more stress is placed on the binder, the binder exerts additional compressive pressure on the fiber, which in turn clamps and secures the fibers to their surrounding interwoven fibers to a greater extent. With the fibers held more firmly in place, the tensile strength of the fiber is engaged and resists and absorbs a higher amount of the stress that was put on the structure, similar to the way Chinese finger cuffs work. Applying a glue between layers is another way to attach the fibers together.

Instrumentation on the compression equipment can be used to determine compression on the fiber. Instrumentation also makes it easier to vary the fiber compression in different parts of the process so as to regulate compressive strength and insulation value. It may be desirable to increase fiber density near the bottom of a wall in order to minimize structural compression. By the same token, fiber may be compressed less dense higher in a wall to enhance insulation value.

After loose straw 14 is added, plaster 22 is inserted between plaster spacer 26 and release membrane 50 by spreading, shoveling, pneumatic pump sprayer or any other suitable application method. To improve the adhesion of the plaster to the fiber, it is often desirable to moisten or coat the outer area of the fiber where the fiber and plaster meet. This can be accomplished with a surface material on the fiber side of plaster spacer 26 which will absorb liquids and release them to the fiber. Depending on the plaster and the fiber characteristics, a number of mixtures can be used such as water, clay slip, wheat paste, lime water, or any other suitable material. As shown in FIG. 2A, plaster 22 is added above the level of the layer that is to be compressed, as the plaster will also tend to be pressed down during compression. Plaster spacer 26 is then removed, and pressure plate 52 is lowered over loose straw 14 to compress it.

Figure 2B:
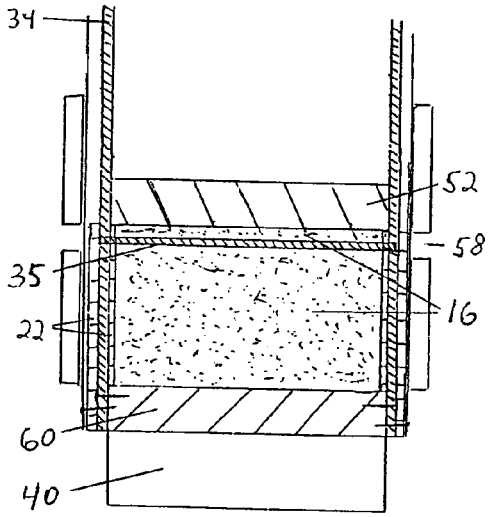
Figure 3A:
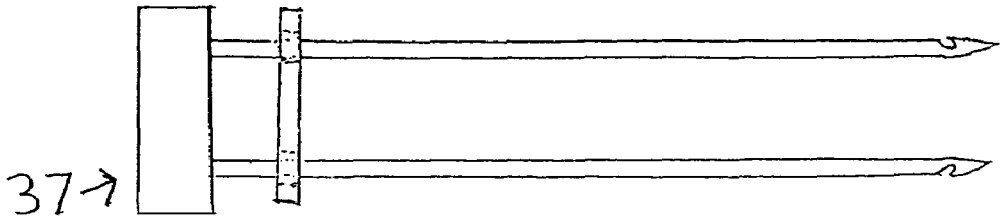
FIG. 3A is a detail drawing of a wire binding tool.
Figure 3B:
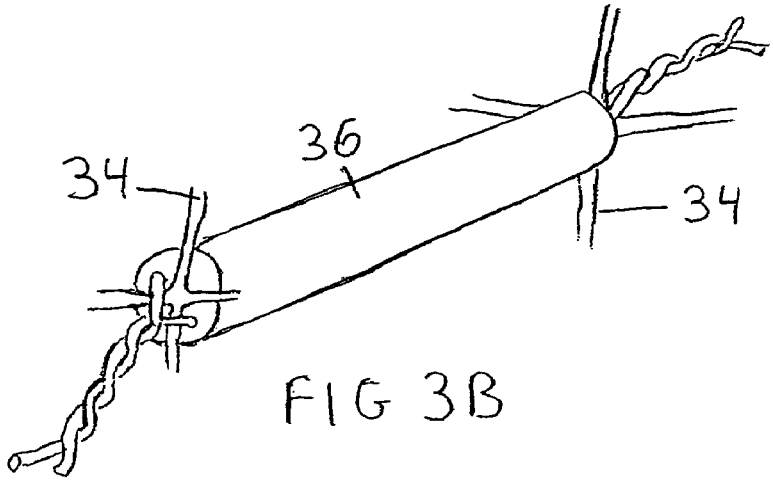
FIG. 3B is detail drawing of a rigid tie retainer.

Referring now to FIG. 2B, while the straw is compressed, a wire 35 is fastened to both right and left sections of mesh 34, which binds the straw that is now designated compressed straw 16. Wire wrapping tool 37 shown in FIG. 3A is used to insert and tie wire 35. Wire wrapping tool 37 connects mesh 34 on each side of the wall together in a manner which encloses and secures the compressed straw 16. Wire wrapping tool 37 is operated by inserting its prongs through the access gap 58 between the lower and upper form boards 64 in such a way as to encompass a section of mesh on both sides of the wall and extend the prongs out the other side of the wall through access gap 58 between form boards 64 on that side. Each end of a sufficient length of wire 35 is then hooked onto the ends of the prongs of wire wrapping tool 37. Wire wrapping tool 37 is then pulled back through the wall. Next, the sliding bar is slid down the prongs, wire wrapping tool 37 is then rotated so as to wrap the wire ends together. This tightens the wire around the mesh, securing the compressed straw 16. After compression, when the pressure plate 52 is raised, a rigid tie like the rigid tie 36 shown in FIG. 3B can be inserted and tied between the wall surface meshes to increase transference of forces, if desired.

Figure 3C:
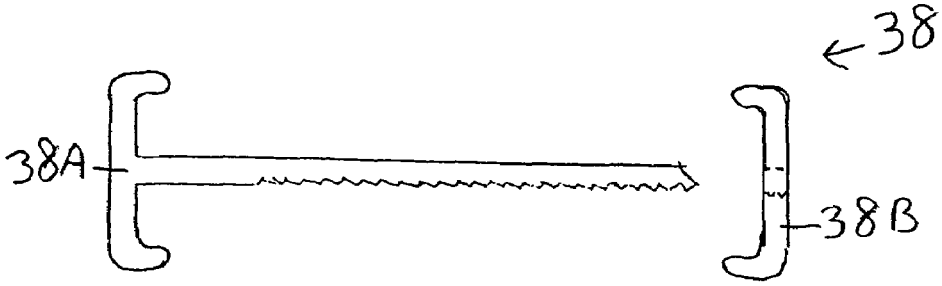
FIG. 3C is a detail of a self locking retainer.

Another way of tying the mesh layers together is shown in FIG. 3C. FIG. 3C shows locking retainer 38, another binding device that is self locking and can be used in lieu of wire wrapping tool 37 and wire 35. Locking retainer 38 consists of two parts. Locking retainer component 38*a* has a bar with angles at each end that are long enough to grab at least one section of mesh 34 without being allowed to pass through. This part also has a shaft, perpendicular to the bar, which contains locking teeth. The shaft is of sufficient length to span the width of the wall and is inserted through the wall and extends out the other side through the access gap 58 between form boards 64 as described above. Locking retainer component 38*b* contains an angled bar similar to the first part that is wide enough to grab mesh 34 without its being allowed to pass through, and locking retainer component 38*b* contains an opening with locking teeth that mate with the teeth of locking retainer component 38*a* when it is passed therethrough. Locking retainer 38 may be made of any suitable material. The two components of locking retainer 38 lock together, similar to a cable tie, which once in place, can be cinched tighter, but cannot be reversed.

In addition, and for increased strength, binding connections between the wall surfaces can be attached at diagonals to the wall surfaces. Used in this way, forces can be transferred between wall surfaces in a manner better than any prior art.

Figure 2C:
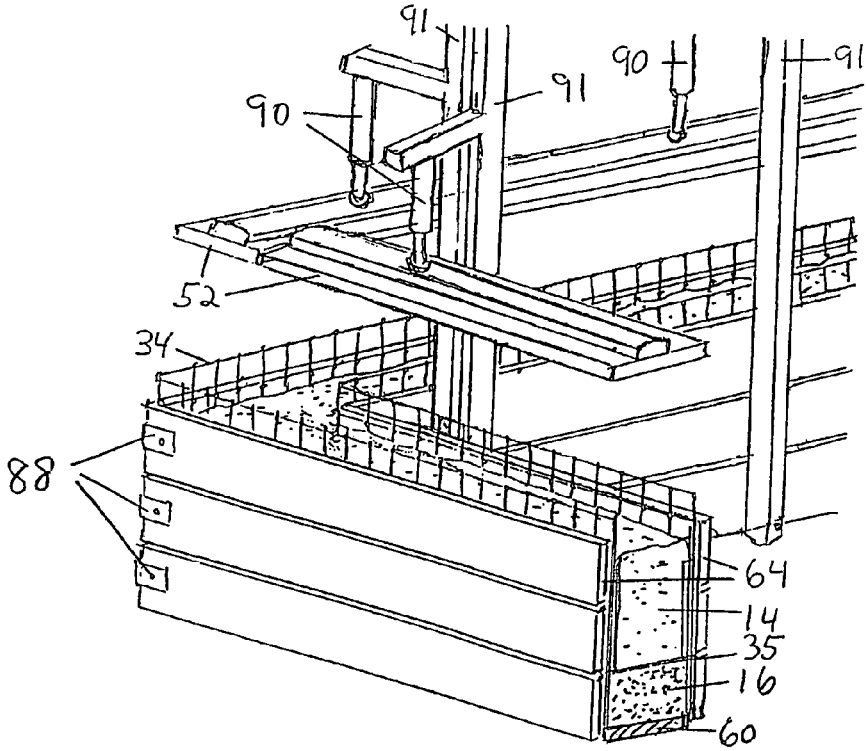
FIG. 2C is a perspective drawing with a cross sectional cutaway of a method of ding by compressing straw in layers.

Referring now to FIG. 2C the addition of two more form boards 64 are placed on top of the previous course of form boards 64. As the wall goes up form boards 64 can be rotated from bottom to top as the wall rises, provided they are supported, thereby reducing the number of form boards 64 required and allowing access for touching up plaster 22 on lower level areas while the plaster is still pliable. Whenever adding higher levels of form boards, care should be taken to keep walls aligned. Additional aligning support boards can be fastened to the outside faces of form boards 64 to align and stabilize the forms if needed. The layering then proceeds with the connection of mesh 34 and release membrane 50 as required. Plaster spacer forms 26, loose straw 14, and plaster 22 are reintroduced and the process continues as in the description above. FIG. 2C also shows a typical corner angle bracket 88 attaching the form boards 64 at the corners. As shown in FIG. 2C, construction of a structure is not limited to one wall panel or surface at a time. Multiple wall surfaces can be constructed simultaneously. In longer runs of wall assemblies, spreading of form boards 64 can occur, as can bowing of pressure plate 52 if not stiff enough. When this happens, to avoid an inadequate and uneven compression of the fiber, it must be corrected by reinforcing form boards 64 and pressure plate 52.

A possible support, labeled support apparatus 91, and pressure apparatus labeled hydraulic ram 90 are shown secured to the base of the wall. Support apparatus 91 connections can be implemented by casting an attaching device in a poured concrete foundation or fastening it afterwards. Various support apparatuses can be used. Centering the hydraulic ram between two support apparatuses tends to equalize and stabilize the forces exerted, which makes vertical aligning of the walls easier. FIG. 2C shows a hydraulic pump, pressure gauge, and control unit 98. Hydraulic rams, which can be controlled remotely and which also have pressure gauges enabling verification of desired compression, are preferred.

Figure 4A:
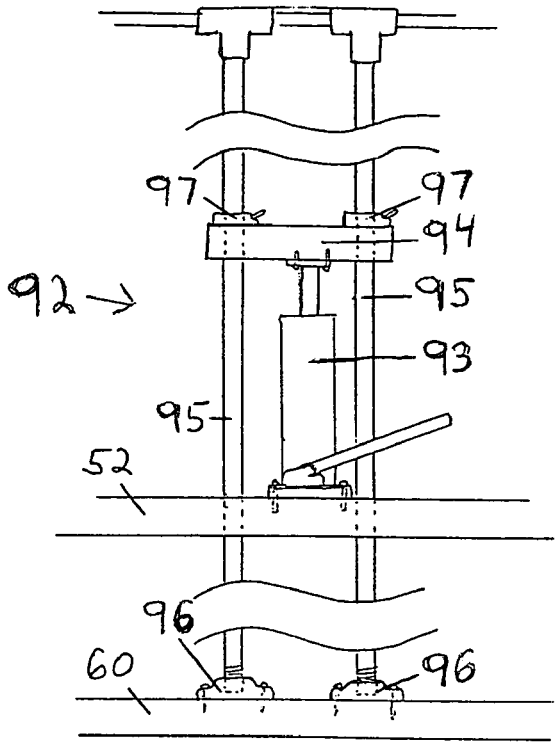
FIG. 4A is a detail of a compression device mounted in the center of a wall.

The support apparatus can also be attached in the center, within the forms, as shown in FIG. 4A. FIG. 4A shows a compression assembly 92 in which all of the items can be commonly found at a hardware store. Hydraulic jack 93 is fastened between pressure plate 52 and mount 94. Pressure plate 52 and mount 94 have openings drilled through them so they can slide along the two pipe supports 95. Pipe supports 95 are attached at their base to bottom plate 60 by floor flanges 96. Located above mount 94 are the sliding clamp side of two pipe clamps 97, which can be slid and clamped to adjust and secure mount 94. The upper ends of pipe supports 95 are also shown stabilized. To compress the fiber, hydraulic jack 93 is then engaged to apply pressure on pressure plate 52. Attaching the support apparatus in the center helps with the vertical alignment of the walls. These supports within the wall can be designed to be removed later or can be left in place where they could serve as structural support.

Heavy equipment often found on construction sites can be used to apply the pressure required. The use of a back hoe or other suitable moveable device to apply pressure to pressure plate 52 is a versatile way to build using this method. Using a back hoe, a section of a wall is compressed by applying pressure to a pressure plate over that section, the section can then be bound, and the procedure can be repeated on the next section. The back hoe in effect has its own way to support itself and exert pressure. The added mobility of a device such as a back hoe enables a smaller forming system to be used, provided it can also be repositioned. A back hoe can also be used to lift and reposition these forms. Many other types of devices are possible to use to apply the pressure needed to compress the fiber.

Figure 4B:
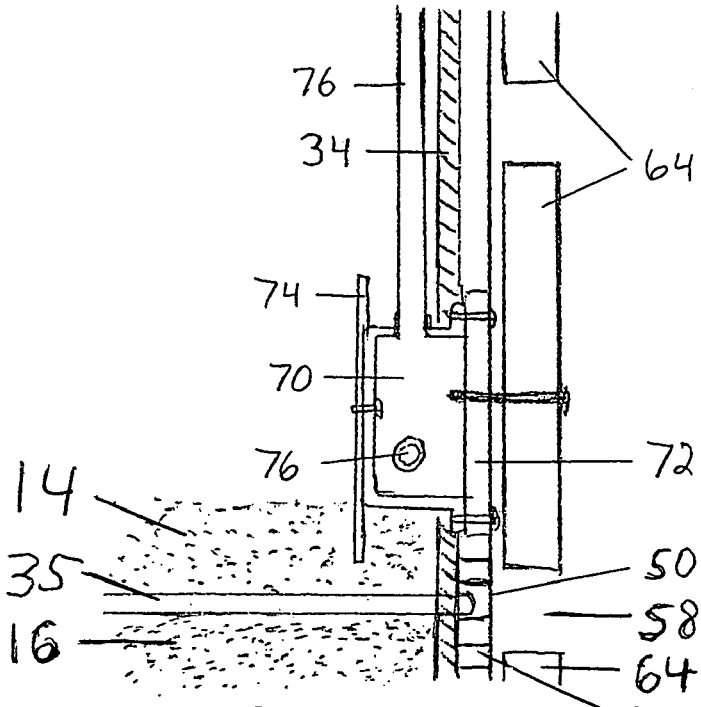
FIG. 4B is a detail of an electrical outlet installation.

The flexibility of the present invention makes installing building features like electric, plumbing, structural supports, and other in-wall items less complex then their installation is in other building methods. FIG. 4B shows an outlet box 70, above a layer of compressed straw 16. Outlet box 70 is attached with screws to a spacer attachment plate 72, and then pushed down into the loose straw 14 shown above wire 35 so it seats firmly. Spacer attachment plate 72 is then temporarily screwed to form board 64. Outlet box 70 can be fastened instead to mesh 34, if desired. At the backside of outlet box 70, and attached flush to it with screws, there is an anti-pullout flange 74 to resist dislodging of outlet box 70 when plugs are inserted and removed. If the outlet box 70 is placed higher than a compressed layer of straw 12, an additional support of straw, wood, foam or any other suitable material may be used. Conduit or Romex may also be supported if need be by a similar suitable method.

FIG. 4B shows conduit attached to outlet box 70 at the side and top. To run conduit vertically a hole can be drilled through the pressure plate for clearance. If Romex is run vertically, a tube can be used to guide the Romex through the pressure plate. After compression the tube can be removed. An advantage of this method of building is that the electrical devices are installed when there is ample clearance. This reduces the time required to rough-in electrical devices.

Other building features can be including in a similar way. Furring strips are installed in a manner similar to the way vertical conduit is installed in that the pressure plate is modified for clearance. The furring strips are used to provide a rigid attaching member for hanging kitchen cabinets or other items. Support members can also be installed in this manner including wood framing, steel framing, hollow tubes with steel reinforcement to pour concrete into later, and any other supports. Horizontal reinforcing members can be installed also. An advantage of the present invention is that when additional support for a wall, roof, floor, ceiling, and/or vault for heavy loads is required, the support members can be included with little modification to the building process.

Framed openings for windows and doors can be installed in a number of ways including, erecting their framing first and putting up the fiber afterwards, leaving the window and door areas void of fiber and afterwards framing the openings, or using dummy blocks during compression and when the wall is complete removing these blocks and then framing. Headers can be installed when the fiber layers get to the height desired. By adapting these techniques, components such as built in cabinets or other items can be installed.

Figure 5A:
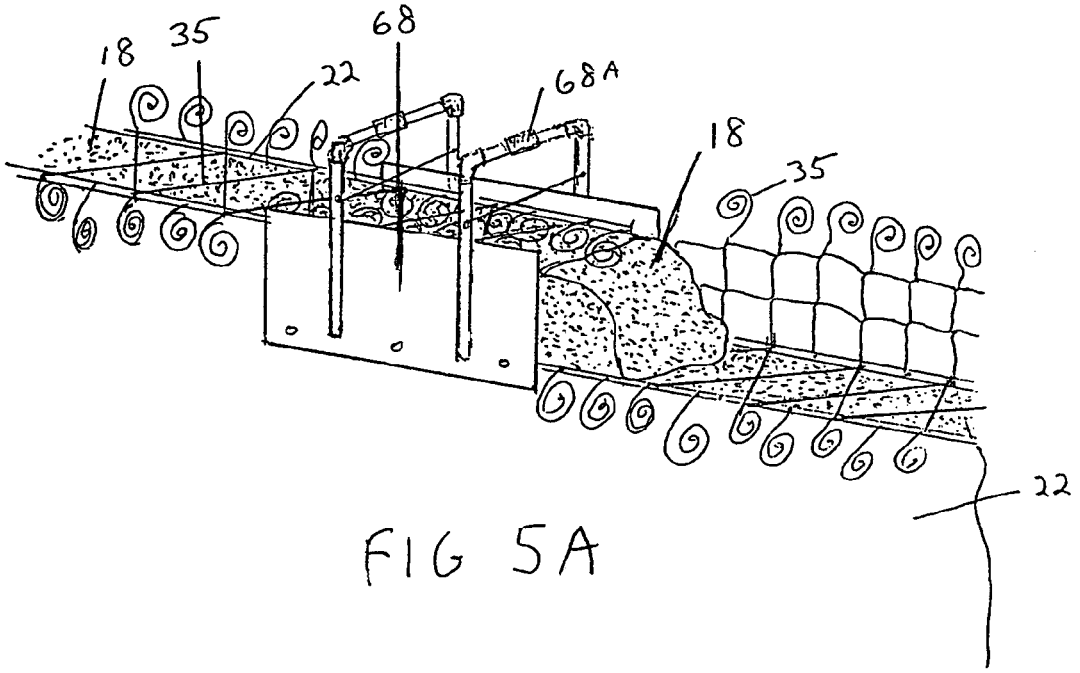
FIG. 5A is a perspective drawing of an adobe construction process.

FIG. 5A—Additional Embodiment

A type of adobe wall can be formed, bound and plastered in a similar way as described FIGS. 2A, 2B and 2C by using a mixture of earth and straw in lieu of the fiber. This differs from a conventional adobe wall in that the adobe is not fashioned into blocks, nor is it mortared. Tamping is sufficient compression for this process. No high pressure apparatus is required. The material can be manipulated into the corners of the cavity by hand or other suitable tamping device. The earth and straw mixture should be sufficiently moist to be workable, but should also be dry enough to admit a tight binding. Also, the straw is best left long in order to facilitate intermeshing of the fibers. When building with adobe the forms need to be well supported because of the adobe's high density. Constructing intersecting walls at the same time together will also help to stabilize adobe walls. Besides having a high density, adobe is unstable until dry. Layers of adobe are best added on only after the lower layers are stable enough to admit them. Well designed forms and binder apparatuses can mitigate a lot of stability concerns during construction, and perhaps all stability concerns in some circumstances. Still, it is very important that wall erection stability be addressed satisfactorily at every stage of building. Although larger forms are a preferred method in that they allow for the construction of larger wall units at a time, smaller, movable forms can be utilized to create complex structures in smaller segments. One such method is described below.

In FIG. 5A the box form 68 is shown on a wall under construction. This type of form was originally used during the depression era to build stone and mortar walls efficientently. Box form box 68 has an adjustment control 68*a*, which attaches the box form face plates and allows the plates to be adjusted in or out. This allows for variation in the wall thickness and facilitates the movement of the form. Box form 68 can be placed in position, filled with adobe 18 and plaster 22, and bound with wire 35, whereupon the box form 68 can be moved to the next location and the process repeated. To construct a wall of adobe 18 with the box form 68, a procedure to create a grid cage from a series of wires which enclose the adobe 18 can be used. There are many binder wire patterns that can be used to create a grid. A description of one of the possible wire patterns follows.

A plurality of wires are first fastened at spaced intervals along each side of a bottom plate. It is best to have some method of keeping the different wires separate so as to keep track of each wire throughout this process and to avoid unwanted tangles. Coiling each individual wire 35 is one way to do this. After fastening the wires to the bottom plate, measure a length of wire 35 up from the bottom plate and bend it over to the wire 35 next to it. At the intersection wrap the first wire 35 around its neighboring wire 35 and bend it upwards while bending the neighboring wire 35 over to the wire 35 next to it. Repeating this procedure creates a mesh of wire similar to the mesh in a chain link fence.

When the wire mesh on each side of the wall is at the height of the next layer of adobe 18, the box form 68 is positioned around the wire mesh. Keeping the height of a layer of adobe 18 less then the thickness of the wall aids the wall's stability. The box form 68 is designed to be adjustable with the intent of clasping the wall or a bottom plate below it in order to hold it in place. Additional support may be required to hold the box form 68 in place. If so, pins can be inserted through holes at the base of the form and pushed into the lower level wall. After positioning box form 68, if plaster 22 is to be applied, a plaster spacer form and form release membrane 50 can be used as in the above discussion. Care should be taken here to extend the adobe 18 past the point where it is bound with wire 35 at the end of the form so that the fibers in the adobe 18 can interweave with the next addition of adobe 18. The binding wires are now used to complete the three dimensional grid by connecting the wall surfaces. As before there are a number of different patterns of wire 35 that can be employed to do this. The pattern chosen should meet the structural requirements. An alternating diagonal pattern is illustrated. This process of forming and binding of adobe is then repeated through each layer.

An advantage of self woven wire meshes is that they are very flexible and structures can be sculpted. They also can decrease expenses. There are a number of improvements on a traditional adobe wall by using this method. First, a monolithic adobe wall is constructed. Second, a framework of wire is created that vastly improves the structures strength. Third, the wire binding supports and reinforces the plaster and fourth, the fashioning of adobe blocks and mortaring them is avoided. When wanted, electric and other features can be installed as is previously described in the above. The adding of plaster 22 and adobe 18 can be altered in some cases in that the wire binding cage can connect the wall surfaces first before plaster 22, and adobe 18 are added, provided they can be added through the cage. It is also possible to do away with the box form 68 altogether if the binding is sufficient to encase the adobe 18. Plenty of long straw in adobe 18 facilitates this process. A well supported and tied binding system of mesh on wall faces can work well, provided care is taken to stabilize the heavy adobe during construction.

The use of a more sophisticated binding such as a premade mesh or a self locking binding will speed up adobe construction but increase binding cost. In either case it is preferable that care should be taken so that the straw element in the adobe is to some degree interwoven to adjoining adobe, so a monolithic bound adobe wall with interwoven fibers is created. Care should be used in the selection of plaster with adobe. The tradition lime plaster over adobe works well.

Figure 5B:
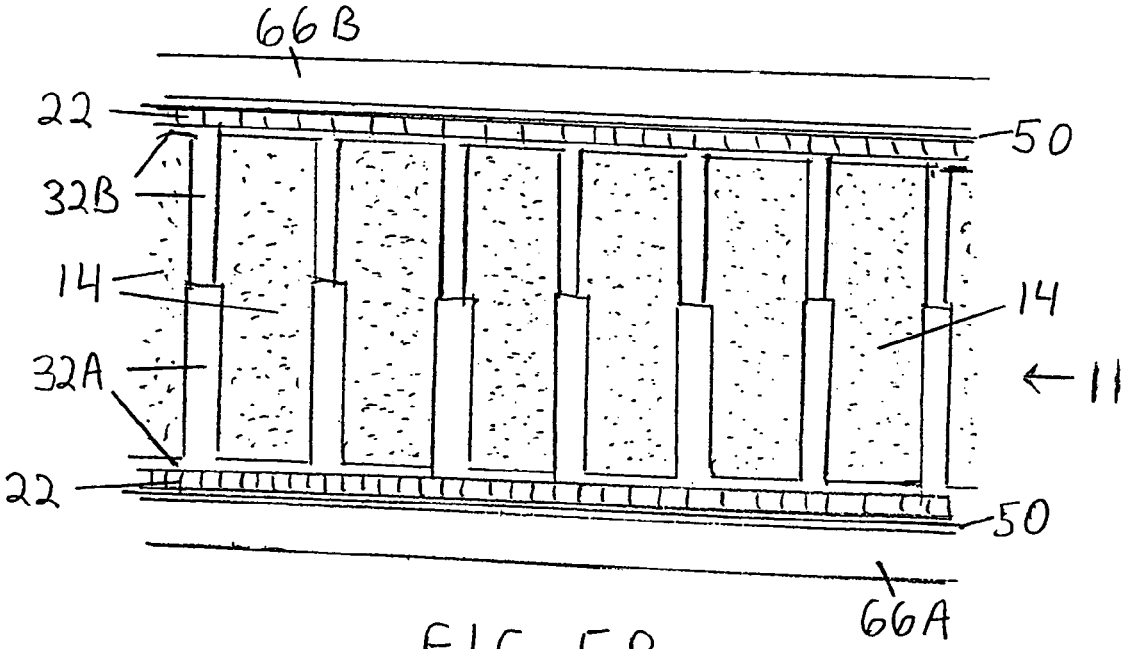
FIG. 5B is a cross section illustrating a method of building by compressing straw panels.
Figure 6A:
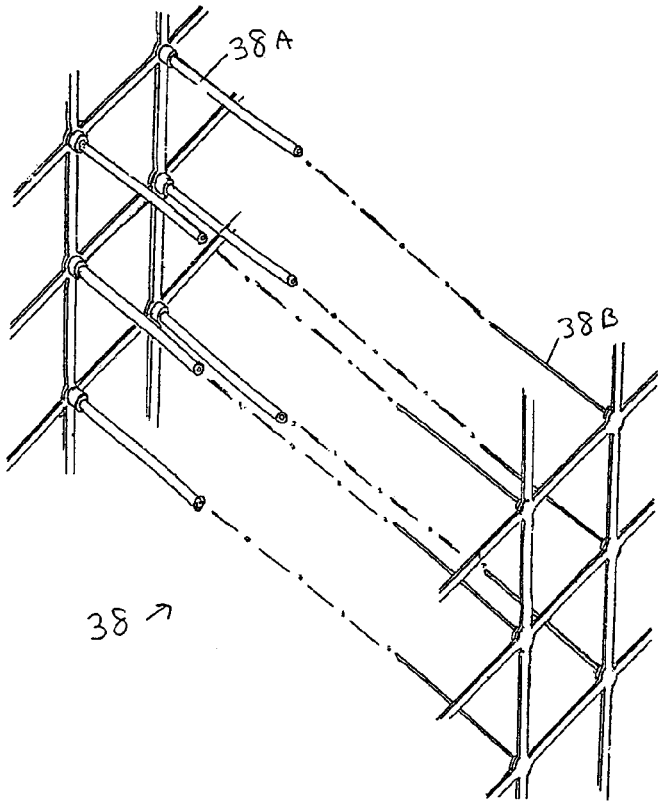
FIG. 6A is a perspective drawing of a locking mesh.
Figure 6B:
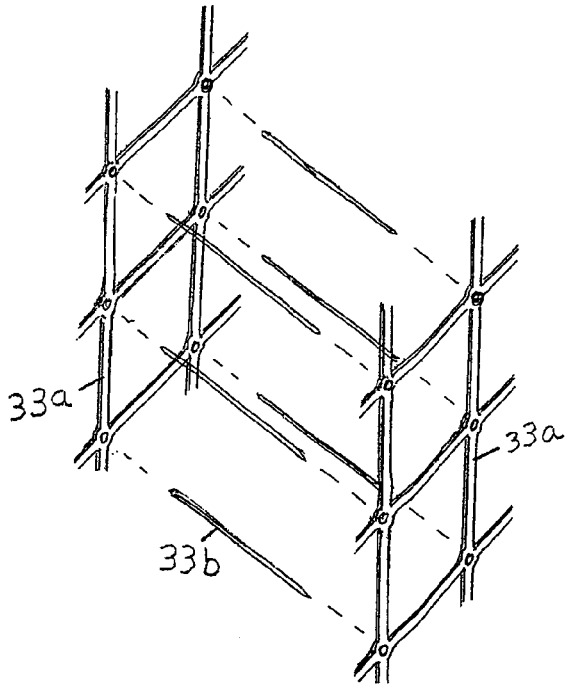
FIG. 6B is a perspective drawing of a locking mesh with separate prong.

FIGS. 5B,6A,6B Additional Embodiment

The method of the present invention also works in the construction of whole walls, panels, modular units, and structures in a single forming and/or compression operation. This requires specific equipment to accomplish and there is a multitude of possible equipment designs. FIG. 5B is an illustration of one possible set of procedures and materials to construct a wall panel in a single forming and compression operation by exerting pressure to a wall surface. FIG. 5B is a drawing of a wall assembly, generally designated 11. At the bottom is surface form 66*a*. It is covered with form release membrane 50. On top of form release membrane 50 is added a layer of plaster 22. The role of form release membrane 50 is to separate plaster 22 from bottom surface form 66*a*, if required, as would be the case if plaster 22 were to stick to bottom surface form 66*a*. FIG. 6A shows a detailed illustration of self locking mesh 32, consisting of locking mesh 32*a* and locking mesh 32*b*. Locking mesh 32*a* has a mesh grid with perpendicular tubes at the intersections. Locking mesh 32*b* has a mesh grid with perpendicular shafts extending from the mesh intersections. Opposing shafts and tubes have interlocking teeth that lock together, similar to a cable tie, which once in place, can be cinched tighter, but cannot be reversed. Returning now to FIG. 5B, locking mesh 32*a* is set on top of plaster 22, prong side up. Loose straw 14 is then added, along with locking mesh 32*b*, the other part of the self locking mesh binding, prong side down on top of loose straw 14, taking care to align the prongs on locking mesh 32*b* with the prongs that extend up from locking mesh 32*a*. A layer of plaster 22 is then applied on top of locking mesh 32*b* and loose straw 12. Form release membrane 50 is then placed on top of plaster 22, and surface form 66*b* is installed above that.

The arrow above support form 66*b* depicts the direction of pressure to be applied. Any suitable method of compression can be used. While locking mesh 32*a* and locking mesh 32*b* self lock with form 66*b* pressure, other types of self locking binders can be made. FIG. 6B shows a locking mesh 33*a* with openings that cinch on prong 33*b*. Any other device that cinches can also be used. Other types of binding that require a different procedure to bind a wall are also possible and the binder chosen is perhaps more suited to the particular way that pressure is applied and the structure is constructed.

This building method can be implemented to build panels in a continuous manner also. For instance, pressure rollers can compress, bind, and even apply wall surfacing as the fibrous material is loaded in through the rollers. Panels may be built on or off site. Panels built in a controlled manufacturing environment can be better protected from weather. The flexibility of the building method of this invention allows any number of ways to construct structures and structural components. Panels like assembly 11 can be constructed on site also, with any suitable forms and compression equipment. These panels may work in conjunction with a post and beam or other structural support system and serve as wall infill, or constitute their own structural support.

Figure 7A:
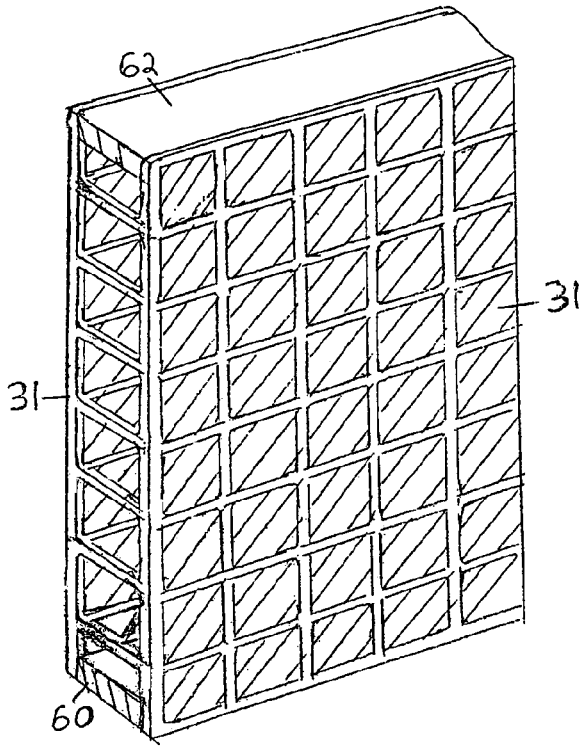
FIG. 7A is a perspective drawing of a binder frame assembly.

FIG. 7A—Additional Embodiment

FIG. 7A shows a binder frame assembly designated 31. It is used to erect walls quickly. It can be a one piece frame or multiple piece frame. The binder frame assembly 31 is erected and then wall surfacing is applied. Binder frame assembly 31 can then be filled with fiber, foam insulation, and any other suitable material or no filling at all. Interior partition walls are one application in which no filler material may be required. If a filler is used it can be inserted by spraying, pumping, or any other suitable way. The wall faces of binder frame assembly 31 have a mesh that will accept a plaster and give it a surface to attach to while also providing reinforcing tensile strength for the plaster. The elements of binder frame assembly 31 which connect the two wall faces together also transfer forces between them which adds additional wall support.

Figure 7B:
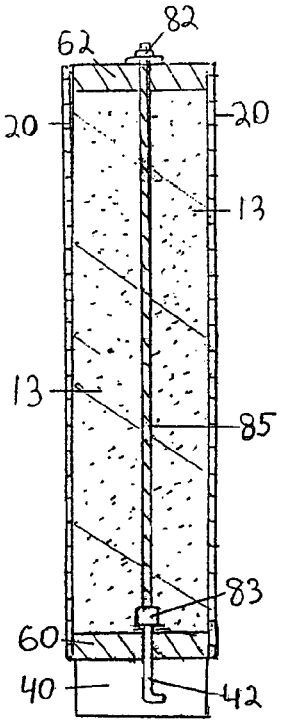
FIG. 7B is a cross section view of a glue and fiber wall.

FIG. 7B—Additional Embodiment

FIG. 7B shows a modular unit or structure bound by a glue and/or cement. Preferably the fiber and glue are compressed, and the glue is a non-toxic glue. Fiber glue mixture 13 is surfaced by wall surfacing 20. To secure the wall a rod 85 is secured to foundation anchor 42 by connector 83 on its lower end and to top plate 62 by nut 82 on its upper end. Any other suitable way to secure the wall can also be used. Glue as a binder can simplify the construction process. Fiber with glue is a very plastic building material which can be cut and shaped to include building features.

Figure 7C:
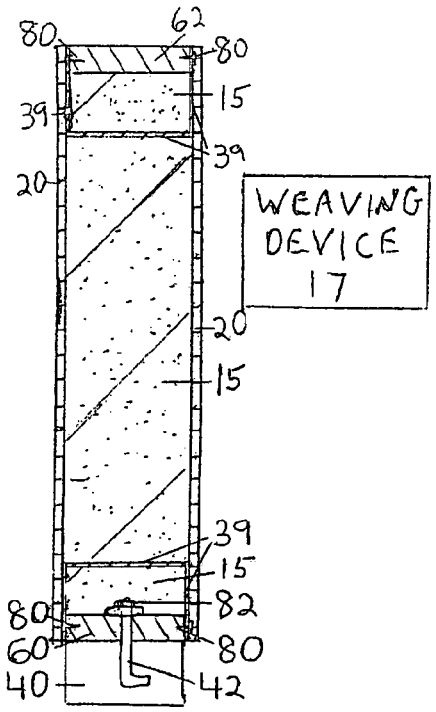
FIG. 7C is a cross section view of a interwoven fiber wall.

FIG. 7C—Additional Embodiment

FIG. 7C shows a wall section of interwoven fiber 15 in which the fibers bind themselves together. Plate to fiber connectors 39 attach the wall to bottom plate 60 and top plate 62. The art of weaving is long standing and sophisticated. Many different weaves are possible, each with its own characteristics. The tighter the fibers are woven together the higher the density. Some weaves are flexible others are rigid. Some weaves will accept a plaster readily, facilitating plastering. There are also many weaving devices that have been developed over time. Hence FIG. 7C shows a weaving device 17 to illustrate the use of a tool and/or machine to weave interwoven fiber 15. A simple and basic example of how to build a interwoven fiber structure is to first begin with a small amount of bound fiber. Then proceed by pushing strands of loose fiber into and between the strands of bound fiber. The fibers will interweave this way. Continuing to interweave fiber will form the structure. Many types of weaves will allow interwoven fiber 15 to be cut and shaped while still maintaining the ability to bind itself, which facilitates the inclusion of building features.

CONCLUSIONS, RAMIFICATIONS AND SCOPE OF INVENTION

It should be apparent to the reader that the present invention, like straw bale building, addresses the same shortfalls of conventional building systems such as rapid depletion of forest resources, excessive waste of both energy and material resources, yet this method surpasses earlier methods of fiber building in many ways, such as:

(a) Fibrous materials can be used to rapidly erect inexpensive, energy-efficient structures.

(b) The binding system and monolithic wall construction technique improves the structural characteristics of a fiber structure.

(c) Steps which are required in straw bale building, such as pre-compression and strapping bales together are eliminated.

(d) It is easier to control wall thickness and to create flat wall surfaces with this method.

(e) Installation of building features including structural reinforcement, plumbing, electrical equipment and other components are better facilitated, with fewer encumbrances.

(f) Time and labor to apply plaster is reduced, as well as the amount of time the straw is exposed to the elements.

(g) There can be more control over compression to increase load bearing capacity, insulation value, and stucco adhesion, which also improves structural strength.

(h) Strong, safe structures can be built with renewable resources and refuse materials.

(i) The method is scalable to accommodate any level of design complexity and builder skills.

(j) The physical characteristics of building materials and their arrangement in a structure can be reduced to quantifiable characteristics. From these quantifiable structural characteristics, simulations and calculations regarding how a structure will respond to stresses can be determined. This feature of the invention aids architects, engineers, and building inspectors in designing safe structures.

One of the characteristics of the present invention is its flexibility. Just as "stick-frame" or conventional framing has its degrees of complexity to accommodate any shape or design of building using various materials, so the present invention's ramifications are widespread in scope. The above description contains many specificities. These should not be construed as limitations on the scope of the invention, but rather as exemplifications of one preferred embodiment thereof. Many other variations are possible, for example, Materials can be substituted for all elements of this building method to suit.

Form systems can be of many shapes and materials, and scaffolding can be included as part of the forms.

Fiber can be compressed between trusses.

Trusses can also be built using this method.

Orientation of the fibers can be directed so as to modify the structure's characteristics.

Binding can be performed by machines.

Bindings of fiber can be used to facilitate the construction of furniture as an element of a structure or as a stand alone piece of furniture.

Construction can be performed on-site by the owner-builder and can be expanded to accommodate larger developments and commercial building needs using the same basic principles.

Construction can be done by hand or industrialized and automated to any degree desired.

Operations and techniques in this method can be mechanized to any degree limited only by the ability and skill one has to design and build such machines. It is expected that with time and incentive this invention will be further automated.

Machines to use the fiber as its own binder by weaving and interlacing the fiber can be made to create a sturdy structure with or without additional binding.

Multiple layers of wall, for example, adobe and compressed fiber, can be erected with this method. Multiple layers can take advantage of a material's particular characteristics such as insulation value, thermal mass, and structural strength.

Wrapping already existing houses is possible. This can save the house from being demolished and/or rebuilt, which saves time and money as well as creating an attractive, appropriate extra-efficient house simply by adding a layer to it.

A additive can be used to increase fire resistance and reduce mold.

Surfacings like flooring and roofing may also be incorporated into this inventions process, for example flooring can be also serve as forming or can be included in the forms.

Monolithic bound structures in which the bound fiber joins floors, walls, roofs, and ceiling in a contiguous manner can be built, which will simplify transitions between these structural elements.

This patent application has provided several examples of surfacing techniques, but naturally, the extent to which surfacing can be performed is limited only to the designer/builder's imagination.

The techniques used to finish the wall surfaces using this method are also limited only to the designer/builder's imagination and skill. Wood siding, for example, can easily be applied to a wall made using the methods of this invention. Forms themselves can be custom prepared to create a signature pattern on the wall surface in relief, which can then be given color and texture. A faux wood finish can be arrived at for example, as can a relief, sculptural effect, and decorative trim, as desired. Again, the invention is flexible enough to allow for these advantages while maintaining the practicality of quick, safe assembly that includes several building steps in one. A unique building may be constructed on-site, or several wall systems using these techniques can be prepared off-site in a factory or pre-fabrication facility to allow for even more ease and rapid, cost-efficient, safe, large-scale production to satisfy the urgency for housing in communities of need, as well as custom design high-end homes.

The above building method of this invention describing a method of building with fiber may well leverage fiber building practices into the same category with conventional building practices, offering a healthy, safe, affordable choice for dwellings.

Thus the scope of the present invention should be determined by the appended claims and their legal equivalents, rather that by the examples given.

I claim:

1. A method of constructing a wall for a building, the method comprising the steps of:

A. providing a layer of loose fibers over a foundation for the wall;

B. applying an amount of pressure to the layer of loose fibers so as to compress the fibers;

C. binding the layer of fibers while the pressure is being applied;

D. applying an additional layer of loose fibers over the previous layer of fibers; applying an amount of pressure to the additional layer of loose fibers so as to compress the fibers;

E. binding the layer of fibers while the pressure is being applied so as to increase the surface of the wall; and F. repeating step D and step E until the wall is completed;

wherein the binding step for each of the additional layers of fibers includes binding the additional layer of fibers to the previous layer of fibers.

2. The method of claim 1 wherein the binding step comprises providing a wire mesh for the front side of the wall and a wire mesh for the back side of the wall and using wire to connect the wire mesh for the front side of the wall to the wire mesh for the back side of the wall so as to hold the compression on the fibers.

3. The method of claim 1 wherein step C and step E comprise using glue or cement for binding the layer of fibers.

4. The method of claim 1 further comprising the step of applying a layer of plaster to at least one of the sides of the wall.

5. The method of claim 1 further comprising the step of providing a bottom plate between the loose fibers and the foundation recited in step A.

6. The method of claim 1 further comprising the step of providing a top plate on the last layer of loose fibers.

7. The method of claim 1 further comprising the step of: providing a bottom plate between the loose fibers and the foundation recited in step A and providing an anchor so as to connect the bottom plate to the foundation; and providing a top plate at the top edge of the wall.

8. The method of claim 1 further comprising the step of applying a layer of plaster to at least one of the side surfaces formed by the layers of compressed fibers and inserting a plaster spacer between the plaster and the at least one of the side surfaces formed by the layers of compressed fibers.

9. The method of claim 1 further comprising the step of applying a layer of plaster to at least one of the side surfaces formed by the layers of compressed fibers and inserting a plaster spacer between the plaster and the at least one of the side surfaces formed by the layers of compressed fibers, and urging the plaster, plaster spacer, and the fiber together.

10. The method of claim 1 wherein the fibers comprise straw.

11. The method of claim 1 wherein the fibers comprise hay.

12. The method of claim 1 wherein the fibers comprise paper.

13. The method of claim 1 wherein the fibers comprise plastic.

14. The method of claim 1 wherein the fibers comprise cornstalks.

15. The method of claim 1 wherein the fibers comprise foam type insulators.

16. The method of claim 1 further comprising the step of applying a wall surfacing material to at least one of the sides of the wall.

17. The method of claim 1 further comprising the step of applying a wall surfacing material to at least one of the sides of the wall so that the pressure applied in step B and step D is applied to the wall surfacing material.

18. The method of claim 1 further comprising gauging the fiber density after step B and step D so as to vary the fiber compression.

19. The method of claim 1 further comprising the step of applying a layer of adobe or a layer of plaster over the compressed fiber formed in step E.

20. The method of claim 1 wherein step A comprises providing earth mixed with the layer of fibers.

21. The method of claim 1 further comprising the step of providing an additive to the fiber so as to increase the fire resistance and reduce mold for the fibers.

22. A method of constructing a wall for a building, the method comprising the steps of:

A. providing a layer of loose straw over a wood bottom plate and providing plaster at the side edges of the layer of loose straw;

B. applying an amount of pressure to the layer of loose straw and the plaster so as to compress the straw;

C. binding the layer of straw while the pressure is being applied and binding the fibers to the bottom plate;

D. applying an additional layer of loose straw over the previous layer of straw; providing additional plaster at the side edges of the layer of loose straw; applying an amount of pressure to the additional layer of loose straw and the additional plaster so as to compress the straw;

E. binding the layer of straw while the pressure is being applied so as to increase the surface of the wall;

F. repeating step D and step E until the wall is completed; and

G. providing a top plate over the last layer of straw and binding the top plate to the last layer of straw;

wherein the binding step for each of the additional layers of straw includes binding the additional layer of straw to the underlying layer of straw.

23. A method of constructing a panel for a building, the method comprising the steps of:

A. providing a first mesh for defining a first side of the panel;

B. providing a second mesh for defining a second side of the panel, opposite the first side;

C. providing a layer of loose fibers between the first mesh and the second mesh;

D. applying an amount of pressure to the layer of loose fibers so as to compress the fibers; and E. binding the first mesh to the second mesh while the pressure is applied so as to substantially keep the fibers compressed.

24. The method of claim 23 further comprising providing a mesh grid so as to lock the first mesh to the second mesh.

25. The method of claim 23 wherein the first mesh and the second mesh comprise a locking mesh.

26. The method of claim 23 wherein the first mesh and the second mesh comprise a self locking mesh.

27. The method of claim 23 further comprising providing a self locking mechanism wherein the first mesh is locked to the second mesh so as to provide the binding of step E.

28. The method of claim 23 further comprising the step of applying a wall surfacing material to at least one of the sides of the panel so that the pressure applied in step D is applied to the wall surfacing material.

29. The method of claim 23 further comprising the step of applying a layer of plaster to at least one of the sides of the panel so that the pressure applied in step D is applied to the plaster.

30. The method of claim 23 further comprising the step of applying a layer of plaster to each of the sides of the panel so that the pressure applied in step D is applied to the plaster.

31. The method of claim 23 further comprising providing a mesh grid comprising shafts and tubes with interlocking teeth configured so as to lock the first mesh to the second mesh.

32. The method of claim 23 wherein the fibers comprise straw.

33. The method of claim 23 wherein the fibers comprise hay.

34. The method of claim 23 wherein the fibers comprise paper.

35. The method of claim 23 wherein the fibers comprise plastic.

36. The method of claim 23 wherein the fibers comprise cornstalks.

37. The method of claim 23 wherein the fibers comprise foam type insulators.

38. The method of claim 23 further comprising the step of providing an additive to the fiber so as to increase the fire resistance and reduce mold for the fibers.

* * * * *